US006036438A

United States Patent [19]

Imai

[11] Patent Number: 6,036,438

[45] Date of Patent: Mar. 14, 2000

[54] TURBINE NOZZLE

[75] Inventor: Kenichi Imai, Yokohama, Japan

[73] Assignee: Kabushiki Kaisha Toshiba, Kawasaki, Japan

[21] Appl. No.: 08/986,163

[22] Filed: Dec. 5, 1997

[30] Foreign Application Priority Data

Dec. 5, 1996 [JP] Japan ..... 8-325592

[51] Int. Cl.[7] ..... F01D 9/02

[52] U.S. Cl. ..... 415/192; 415/208.1; 415/914; 416/DIG. 5; 416/223 A

[58] Field of Search ..... 415/191, 192, 415/193, 194, 195, 208.1, 208.2, 914; 416/DIG. 5, 223 A

[56] References Cited

U.S. PATENT DOCUMENTS 2,710,136 6/1955 Ganahl et al. ..... 415/208.2

FOREIGN PATENT DOCUMENTS 0045405 4/1979 Japan ..... 415/914
0018405 1/1982 Japan ..... 415/914
6-81603 3/1994 Japan .
8-109803 4/1996 Japan .

*Primary Examiner*—Edward K. Look
*Assistant Examiner*—Richard Woo
*Attorney, Agent, or Firm*—Foley & Lardner

[57] ABSTRACT

An optimum axial distance is secured by varying the distance between a nozzle blade and a moving blade along the length of a nozzle blade (11). The nozzle blades (11) are curved so that a middle portion of each nozzle blade has a section (b2) dislocated in the flowing direction of a fluid which flows through the fluid passage relative to the root section (b3) and the tip section (b1) of the blade with respect to a circumferential direction and an axial direction. Outlet flow angle of the nozzle is varied with distance along the blade length to vary optimum axial distance properly.

4 Claims, 14 Drawing Sheets

DISTANCE BETWEEN THE NOZZLE BLADE
AND THE MOVING BLADE
IN THE DIRECTION OF FLOW

TURBINE NOZZLE

BACKGROUND OF THE INVENTION

1. Field of the Invention

The present invention relates to a turbine nozzle suitable for reducing interblade loss caused between the nozzles and the moving blades of a steam turbine to improve the internal efficiency of the steam turbine.

2. Description of the Related Art

Techniques desirable for the performance improvement of steam turbines have been developed and applied successfully to practical steam turbines to achieve high operating efficiency. Noteworthy techniques effective in performance improvement are those relating to the improvement of internal efficiency. Those techniques are capable of being effectively applied to turbines of all kinds of turbine cycles operating under any fluid conditions and are noteworthy because of their capability of application to a wide range of application. Secondary flow loss among internal losses caused within a turbine is common to the many stages of an axial-flow turbine. The internal efficiency of a turbine is greatly dependent on measures taken to reduce secondary flow loss.

Incidentally, close examination of the shape and arrangement of blades is essential to the reduction of secondary flow loss attributable to vortices in the secondary flow generated in the nozzles. Recently developed advanced computer techniques capable of accurate analysis of three-dimensional flows have made possible the close examination and detailed three-dimensional analysis of the shape and arrangement of blades.

As an example of applications of the above-mentioned techniques, it has been known a turbine nozzle which comprises nozzle blades each of which is curved relative to the radial line passing the center axis of rotation of a steam turbine in a curve convex toward the fluid flowing direction with respect to a circumferential direction.

FIG. 6 is a fragmentary view of a part of a stage of an axial-flow turbine employing nozzle blades curved in the foregoing manner. Nozzle blades 1 are held between a diaphragm outer ring 2 and a diaphragm inner ring 3. In this nozzle, as a result of curvature of the blades in the above-mentioned manner, a velocity vector of the fluid flowing through a passage between the nozzle blades 1 is directed toward the diaphragm inner ring 3 in a root side area of the passage, and a velocity vector of the fluid flowing through a passage between the nozzle blades 1 is directed toward the diaphragm outer ring 2 in the tip side area of the passage. Such an action of the nozzle blades 1 suppresses the development of boundary layers on both sides walls of the diaphragm inner ring 3 and the diaphragm outer ring 2.

As another example of applications of the above-mentioned techniques, two types of turbine nozzles have been known which comprise nozzle blades which are arranged so that the ratio S/T, where S is the throat width which is the shortest distance between the trailing edge of the nozzle blade 1 and the back surface of another nozzle blade 1 adjacent to the former, and T is the pitch of the nozzle blades (see FIG. 7), is varied along the direction of the blade length to control flow distribution on the blade length for the improvement of the cascade performance.

One of said two types of turbine nozzles is shown in FIG. 8. Nozzle blades 1 shown in FIG. 8 are shaped and arranged so that the respective throat widths S1 and S3 at the root portion and the tip portion of the cascade are greater than the throat width S2 at the middle portion of the cascade to reduce the secondary flow loss in the vicinity of the side wall surface of the diaphragm inner and outer rings by increasing flow rates in the tip portion and the root portion of the fluid passage between the nozzle blades 1. This type of nozzle will be called a nozzle of a "three-dimensional design 1" hereinafter.

Another of said two types of turbine nozzles is shown in FIG. 9. Nozzle blades 1 shown in FIG. 9 are shaped and arranged so that the throat width S2 at the middle portions of the cascade is greater than the respective throat widths S1 at the root portion thereof and S3 at the tip portion thereof to reduce the secondary flow loss by increasing flow rates, relatively to in the root and tip portion of the fluid passage between the blades, in the middle portion thereof. In the middle portion of the fluid passage of the nozzle designed in above-mentioned manner, the flow of the fluid is not affected by the side wall surface of the diaphragm rings, hence secondary flow loss can be reduced. This type of nozzle will be called a nozzle of a "three-dimensional design 2" hereinafter.

As mentioned above, the performance of the cascade of the nozzle blades can be improved by three-dimensionally controlling the flow of steam by the nozzle blades disposed so that the ratio S/T varies along the length of the nozzle blades.

Interblade loss caused between the nozzle blades and the moving blades of the rotor of a steam turbine is one of the factors dominating the internal efficiency of the seam turbine. The interblade loss, in general, is the sum of unsteady loss and mixing loss, which will be described below.

Referring to FIG. 10 unsteady loss is caused by the passage of the moving blades (not shown in FIG. 10) through wakes. In other words, the unsteady loss is caused by the periodic variation of the inflow angle of the fluid relative to the moving blades due to the variation of velocity component of the fluid outflowing from the nozzle. The depth of the wakes decreases with the distance from outlet of the nozzle as measured in the direction of the flow, and unsteady loss decreases as the depth of the wakes decreases.

Mixing loss is caused by interference between streams of the fluid spouted into a free space. Mixing loss increases with the distance from the outlet of the nozzle in the flowing direction of the fluid. Accordingly, as shown in FIG. 11, the interblade loss $\xi 3$, i.e., the sum of the unsteady loss $\xi 1$ and the mixing loss $\xi 2$, reaches a minimum at a distance where a curve representing the former loss decreasing with distance L (see FIG. 12) in the direction of flow and a curve representing the latter loss increasing with the distance L in the direction of flow intersect each other. The distance where the interblade loss $\xi 3$ reaches a minimum is an optimum value of the distance L in the direction of flow.

Referring to FIG. 12, an optimum axial distance $\delta a$ between a nozzle blade 1 and a moving blade 4 is expressed by:

$$\epsilon a = L_{opt} \sin \alpha_2$$

where $L_{opt}$ is an optimum distance in the direction of flow, and $\alpha_2$ is outlet flow angle of the nozzle. The "distance L in the direction of flow" is the distance between Line $L_n$ connecting trailing edges of the adjacent nozzle blades and Line $L_o$ connecting leading edges of the adjacent moving blades, as measured along the line inclined at inclination $\alpha_2$ with respect to the Line $L_n$. The axial distance $\delta$ is the distance between Line $L_n$ connecting trailing edges of the adjacent nozzle blades and line Lm connecting leading edges of the adjacent moving blades as measured in the axial direction.

In the aforementioned conventional nozzle, the outlet flow angle of the nozzle $\alpha_2$ varies with longitudinal distance from root side end of the blade, as shown in FIG. 14, as a result of S/T variation along the length of the nozzle blades 1 as shown in FIGS. 8 and 9. The outlet flow angle of the nozzle also varies with distance along the length of the blade as a result of curvature of the nozzle blades 1 (FIG. 6).

Accordingly, the optimum axial distance $\delta a$ varies with the value of sin $\alpha_2$ which varies with distance along the length of the blade as shown in FIG. 15. Hence, the internal efficiency of the turbine cannot be satisfactorily improved without optimization of the distance L in the direction of flow between the nozzle blades and the moving blades, even if the nozzle blades are curved circumferentially as shown in FIG. 6, or the S/T varies with distance along the length of the blade as shown in FIGS. 8 and 9, for reducing the secondary flow loss.

SUMMARY OF THE INVENTION

Accordingly, it is an object of the present invention to provide a turbine nozzle designed so as to optimize the distribution of the distance L in the direction of flow between the nozzle blade and the moving blade along the length of the blade in order to improve the internal efficiency of the turbine.

According to the first aspect of the present invention, a turbine nozzle is provided which comprises an annular diaphragm inner ring disposed coaxially with a predetermined axis, an annular diaphragm outer ring disposed coaxially with the diaphragm inner ring so as to define an annular fluid passage between the diaphragm inner ring and the diaphragm outer ring, and a plurality of nozzle blades arranged in a circumferential arrangement in the fluid passage between the diaphragm inner ring and the diaphragm outer ring, and each blade having a root and a tip located respectively at the diaphragm inner ring side and the diaphragm outer ring side, wherein the nozzle blades are curved so that a middle portion of each nozzle blade has a section dislocated in the flowing direction of a fluid which flows through the fluid passage relative to the root section and the tip section of the blade with respect to a circumferential direction and an axial direction.

According to the second aspect of the present invention, a turbine nozzle is provided which comprises, an annular diaphragm inner ring disposed coaxially with a predetermined axis, an annular diaphragm outer ring disposed coaxially with the diaphragm inner ring so as to define an annular fluid passage between the diaphragm inner ring and the diaphragm outer ring, and a plurality of nozzle blades arranged in a circumferential arrangement in the fluid passage between the diaphragm inner ring and the diaphragm outer ring and each blade having a root and a tip located respectively at the diaphragm inner ring side and the diaphragm outer ring side, wherein the nozzle blades are curved so that the ration S/T, where S is the minimum distance between the trailing edge of each nozzle blade and the back surface of the nozzle blade adjacent to the former nozzle blade, and T is the pitch of the nozzle blades, is a minimum at a middle portion of the nozzle blade, and wherein the middle portion of each nozzle blade has a section dislocated in the flowing direction of a fluid which flows through the fluid passage relative to the root section and the tip section of the blade with respect to an axial direction.

According to the third aspect of the present invention, a turbine nozzle is provided which comprises an annular diaphragm inner ring disposed coaxially with a predetermined axis, an annular diaphragm outer ring disposed coaxially with the diaphragm inner ring so as to define annular fluid passage between the diaphragm inner ring and the diaphragm outer ring, and a plurality of nozzle blades arranged in a circumferential arrangement in the fluid passage between the diaphragm inner ring and the diaphragm outer ring and each blade having a root and a tip located respectively at the diaphragm inner ring side and the diaphragm outer ring side, wherein the nozzle blades are curved so that the ration S/T, where S is the minimum distance between the trailing edge of each nozzle blade and the back surface of the nozzle blade adjacent to the former nozzle blade, and T is the pitch of the nozzle blades, is a maximum at a middle portion of the nozzle blade, and wherein the middle portion of each nozzle blade has a section dislocated in a direction opposite the flowing direction of a fluid which flows through the fluid passage relative to the root section and the tip section of the blade with respect to an axial direction.

Preferably, a line connecting a point corresponding to the root side end of a trailing edge of each nozzle blade, and a point corresponding to the tip side end of the trailing edge of each nozzle blade is inclined at a fixed angle toward the fluid outlet side to a radial line of the nozzle blade.

The present invention holds an optimum axial distance for a turbine stage, and reduces interblade loss to improve the internal efficiency of a turbine.

BRIEF DESCRIPTION OF THE DRAWINGS

The above and other objects, features and advantages of the present invention will become more apparent from the following description taken in connection with the accompanying drawings, in which.

DETAILED DESCRIPTION OF THE PREFERRED EMBODIMENTS

Figure 1:
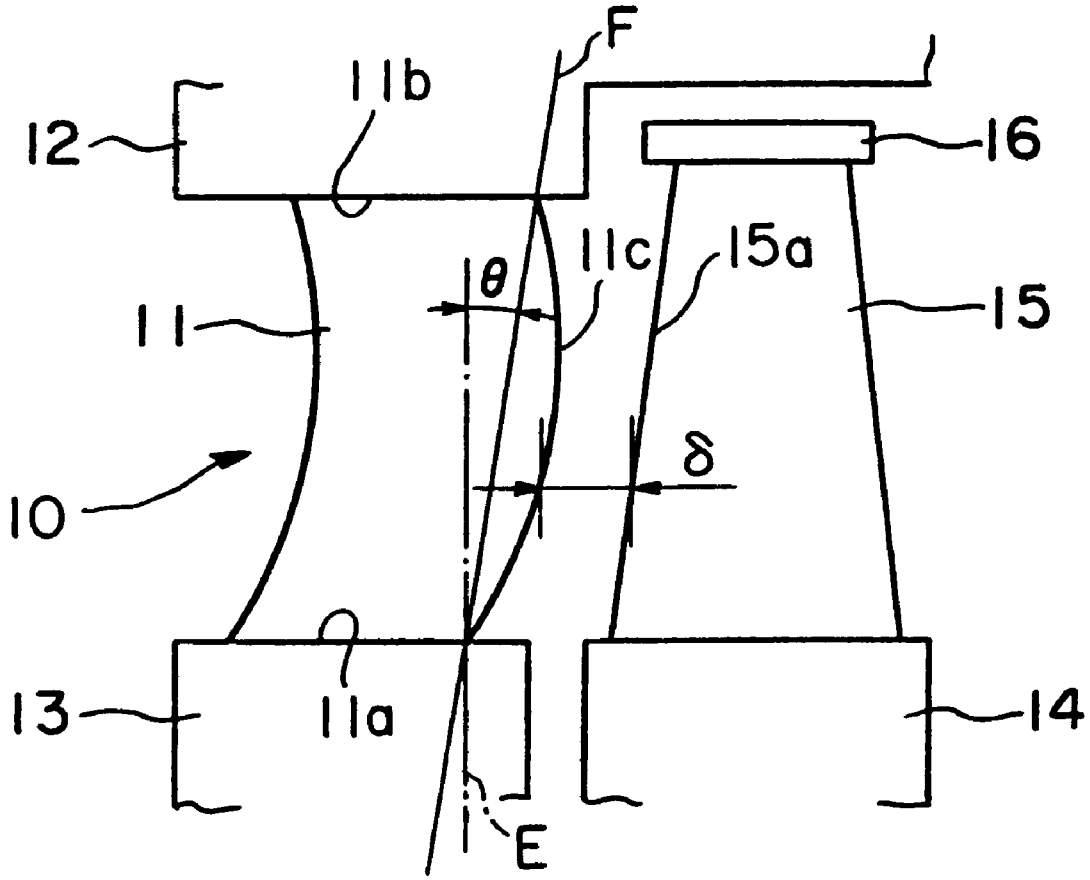
FIG. 1 is a typical view of a turbine stage of a steam turbine, as viewed in a direction perpendicular to an axis of a turbine rotor, employing a turbine nozzle in a first embodiment according to the present invention.

Referring to FIG. 1, a turbine nozzle 10 in a first embodiment according to the present invention comprises an annular diaphragm outer ring 12, an annular diaphragm inner ring 13, and a plurality of nozzle blades 11. The diaphragm outer ring 12 and the diaphragm inner ring 13 are disposed coaxially with a turbine rotor shaft (not shown), i.e., a predetermined axis, so as to define an annular fluid passage therebetween.

The nozzle blades 11 are disposed in the annular fluid passage between the diaphragm outer ring 12 and the diaphragm inner ring 13 n a circumferential arrangement so as to define a plurality of fluid passage sections between the adjacent nozzle blades. Each nozzle blade 11 has a root 11*a* (i.e., a radially inner end) and a tip 11*b* (i.e., a radially outer end) located respectively at the diaphragm inner ring 13 and the diaphragm outer ring 12 side. Only one of the nozzle blades 11 is shown in FIG. 1.

A rotor disk 14 provided with moving blades 15 is disposed axially adjacently to the nozzle 10. The moving blades 15, similarly to the nozzle blades 11, are disposed in an circumferential arrangement. Only one of the moving blades 15 is shown in FIG. 1. The outer ends of the moving blades 15 are connected to a shroud 16. The nozzle 10 and the moving blades 15 form a stage of an axial-flow turbine. A fluid flows from the left-hand side into the nozzles and flows toward the right-hand side as viewed in FIG. 1.

Figure 2A:
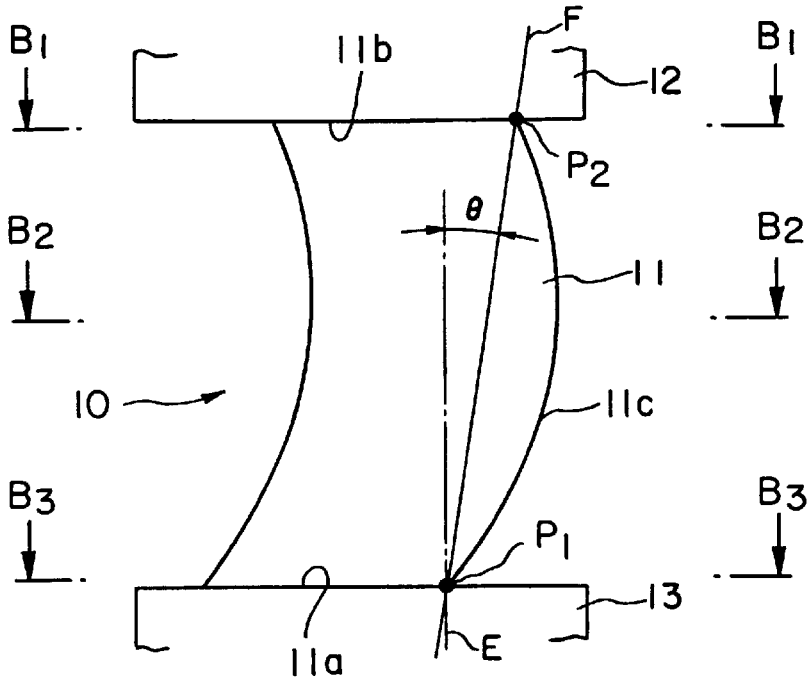
FIG. 2A is a typical view of a turbine nozzle in a first embodiment according to the present invention.
Figure 2B:
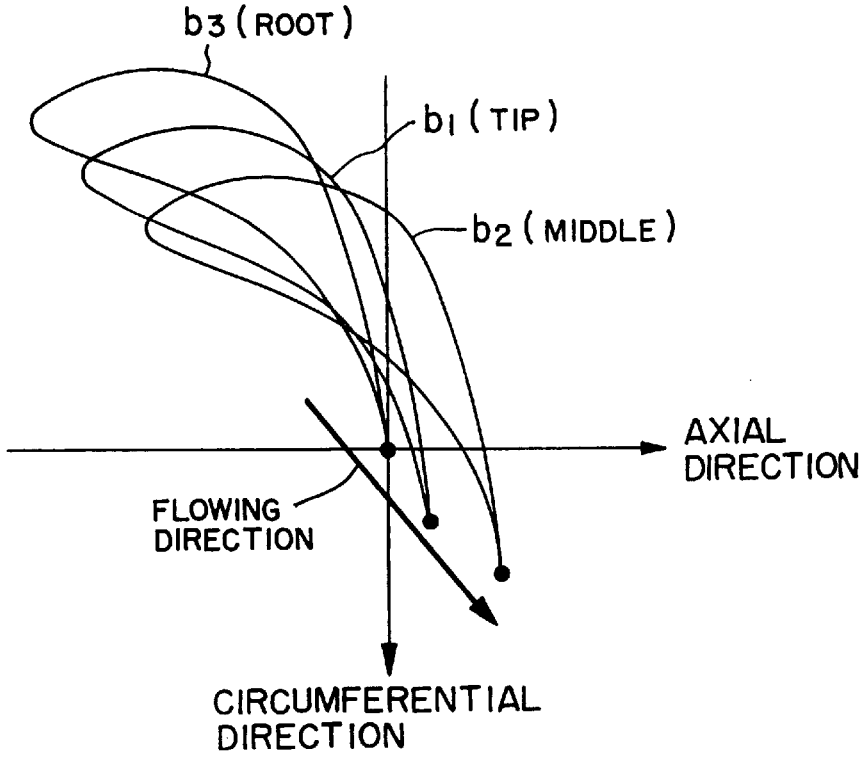
FIG. 2B shows cross sections along B1—B1, B2—B2 and B3—B3 in FIG. 2A.

FIG. 2B shows cross-sectional views of the nozzle blade 11 corresponding respectively to sections B1–B1 (a tip section b1, i.e., a section of a tip portion of the nozzle blade), B2—B2 (a middle section b2, i.e., a section of a middle portion of the nozzle blade) and B3—B3 (root section b3, i.e., a section of a root portion of the nozzle blade) of FIG. 2A. The middle section b2 typically corresponds to PCD section located at a pitch circle diameter of the nozzle. As shown in FIG. 2B, the middle section b2 of the nozzle blade 11 is dislocated in the flowing direction of a fluid which flows through the fluid passage relative to the root section b3 and the tip section b1, with respect to a circumferential direction and an axial direction. In other words, each nozzle blade 11 has sections taken at positions on the blade length and shifted relative to each other so that the section reference line (typically identical with trailing edge 11*c*) of the nozzle blade 11 is curved relative to the radial line E that passes the axis of the turbine rotor in a curve convex toward the fluid flowing direction with respect to a circumferential direction and an axial direction. As shown in FIG. 2B, the flowing direction shown by an arrow is directed from left upper side to right lower side of FIG. 2B, accordingly, the term "the flowing direction with respect to the circumferential direction" means the direction directed toward lower side of FIG. 2B and the "the flowing direction with respect to the axial direction" means the direction directed toward right side of FIG. 2B.

As mentioned above, in the nozzle employing blades curved in a circumferential direction for reducing the secondary flow loss, the outlet flow angle of the nozzle is greater than that of the conventional nozzle employing not-curved blades at the root side portion and the tip side portion of each fluid passage section, and is smaller than that of the conventional nozzle at the middle portion of each fluid passage section. The variation of the outlet flow angle with distance from the root portion toward the tip portion of each fluid passage section of the nozzle entails the variation of optimum axial distance dependent on unsteady loss and mixing loss with distance from the root portion toward the tip portion of the fluid passage of the nozzle; that is, the optimum axial distance is relatively short at the middle portion of the nozzle blade 11 and is relatively long at the root side portion and the tip side portion of the nozzle blade 11. In this embodiment, the nozzle blade is curved in the axial direction as well as in the circumferential direction by shifting the middle section b2 axially relative to tip section b1 and root section b3 to vary the axial distance δ between the nozzle blade and the moving blade with distance along the blade length. Thus, an optimum axial distance can be determined, so that interblade loss can be reduced and the internal efficiency can be further improved.

Referring to FIG. 2A, a line F connecting a point P1 corresponding to the root side of the trailing edge 11*c* of the nozzle blade 11, and a point P2 corresponding to the tip side end of a trailing edge 11*c* of the nozzle blade 11, is inclined toward the fluid outlet side, i.e., right-hand side of FIG. 2A, at an inclination θ in the range of 0 degree to 5 degrees to the radial line E of the nozzle blade 11. The inclination θ is measured as viewed from a direction perpendicular to the radial line E and to the axis (i.e., in a direction perpendicular to the sheet of FIG. 2A).

As shown in FIG. 1, in general, leading edge 15*a* of the moving blade 15 is inclined toward the fluid outlet side, i.e., right-hand side of FIG. 1. Since the curvature of the blade in the axial direction which should be varied in accordance with the variation of the curvature of the blade toward the circumferential direction, is restricted because of manufacturing technique or the necessity of avoiding interference between the nozzle blades 11 and the associated parts, if the line F is parallel to the radial line E, an optimum axial distance in each portion along the blade length can hardly be secured. In this embodiment, since the line F is inclined toward the fluid outlet side, the nozzle blade can be disposed relative to the rotor 14 so that an axial distance nearly equal to an optimum axial distance can be secured even if the nozzle blades 11 can not be formed in an optimum curved shape.

Figure 5:
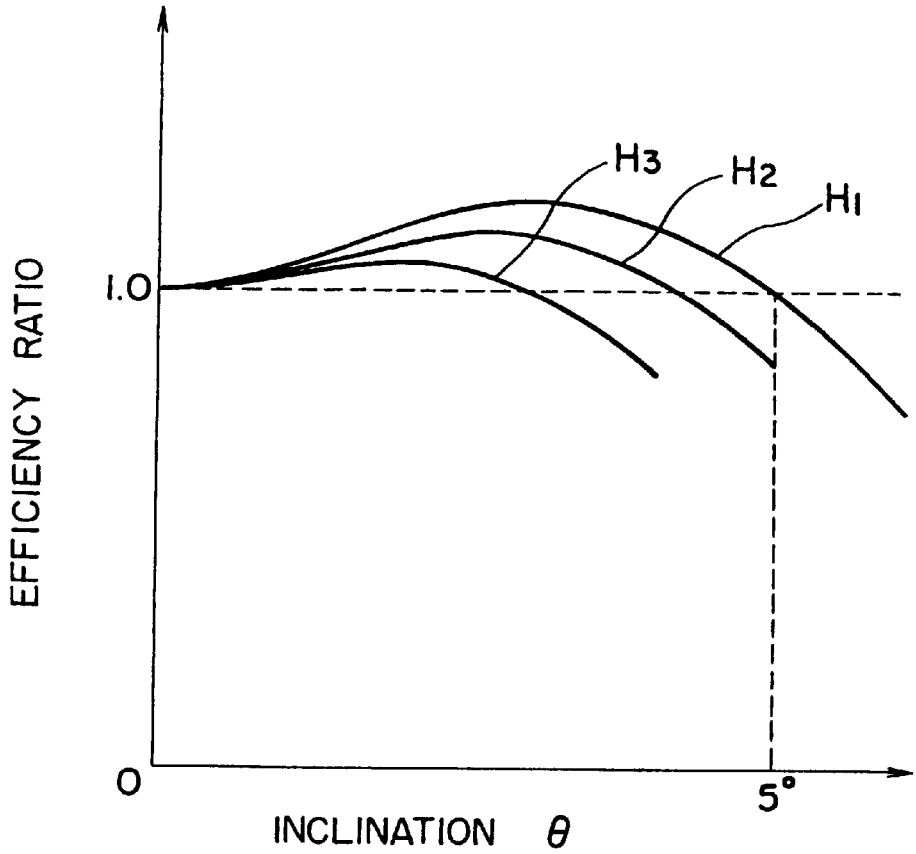
FIG. 5 is a graph showing the dependence of efficiency on the inclination of nozzle blades.
Figure 6:
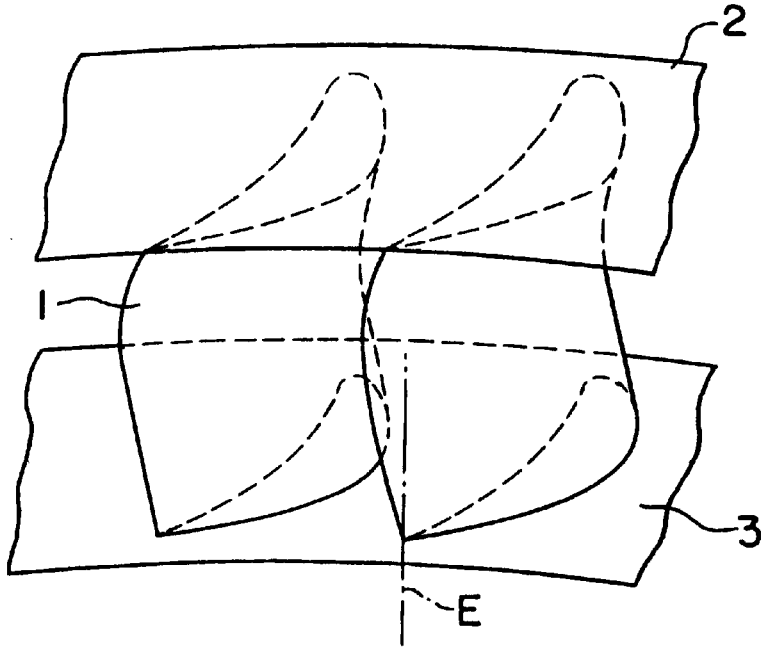
FIG. 6 PRIOR ART
FIG. 6 is a perspective view of a conventional nozzle curved in a circumferential direction.
Figure 7:
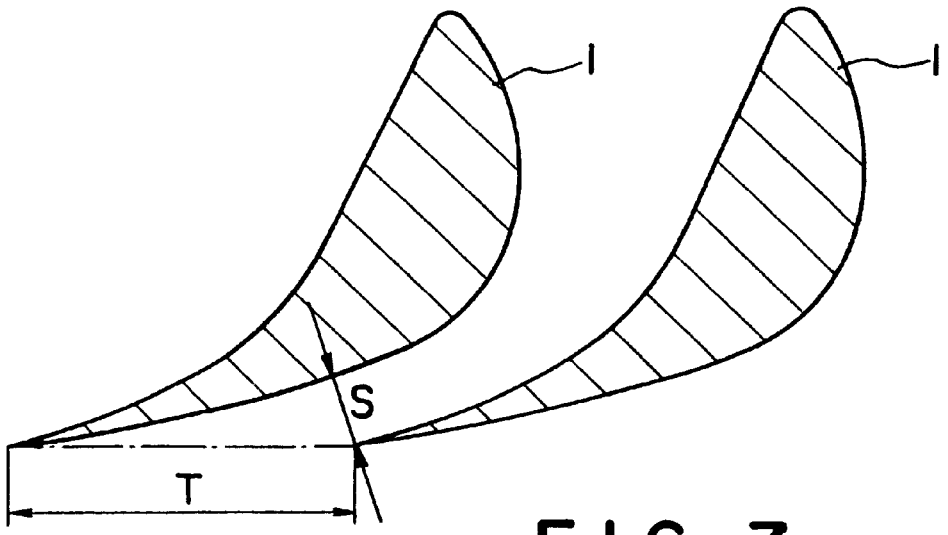
FIG. 7 is a cross-sectional view of the nozzle blade of assistance in explaining a pitch T and a throat width S.
Figure 8:
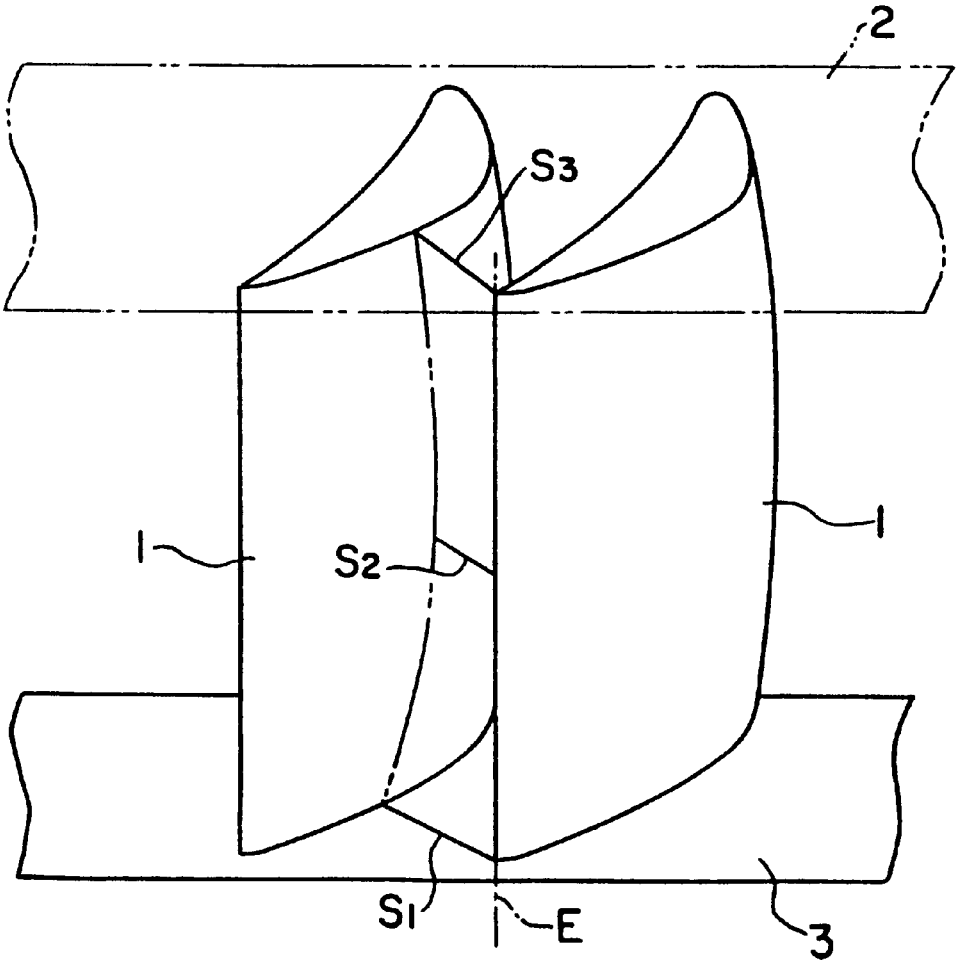
FIG. 8 PRIOR ART
FIG. 8 is a perspective view of a conventional view of a "three-dimensional design 1"
Figure 9:
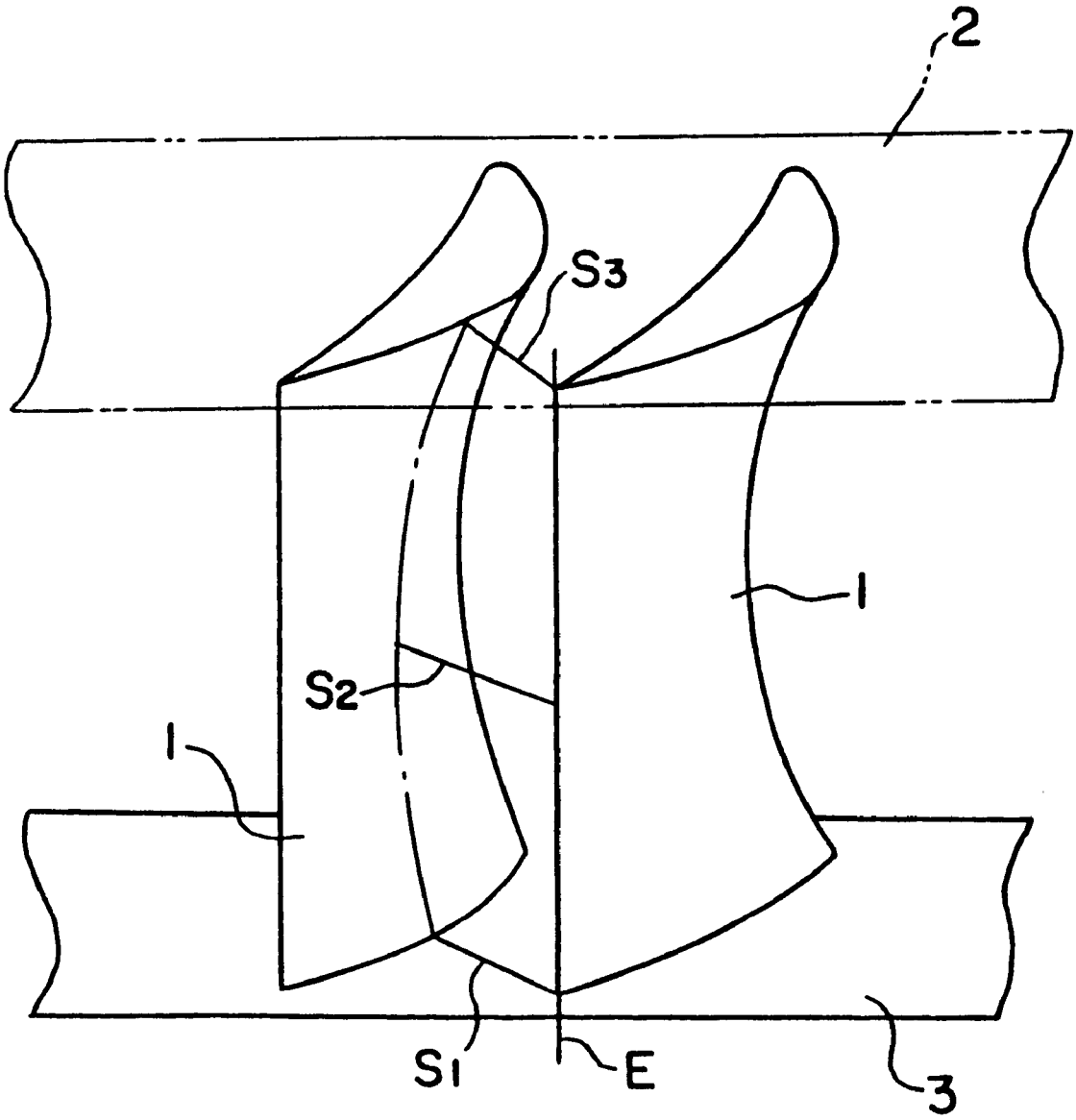
FIG. 9 PRIOR ART
FIG. 9 is a perspective view of another conventional nozzle of a "three-dimensional design 2"
Figure 10:
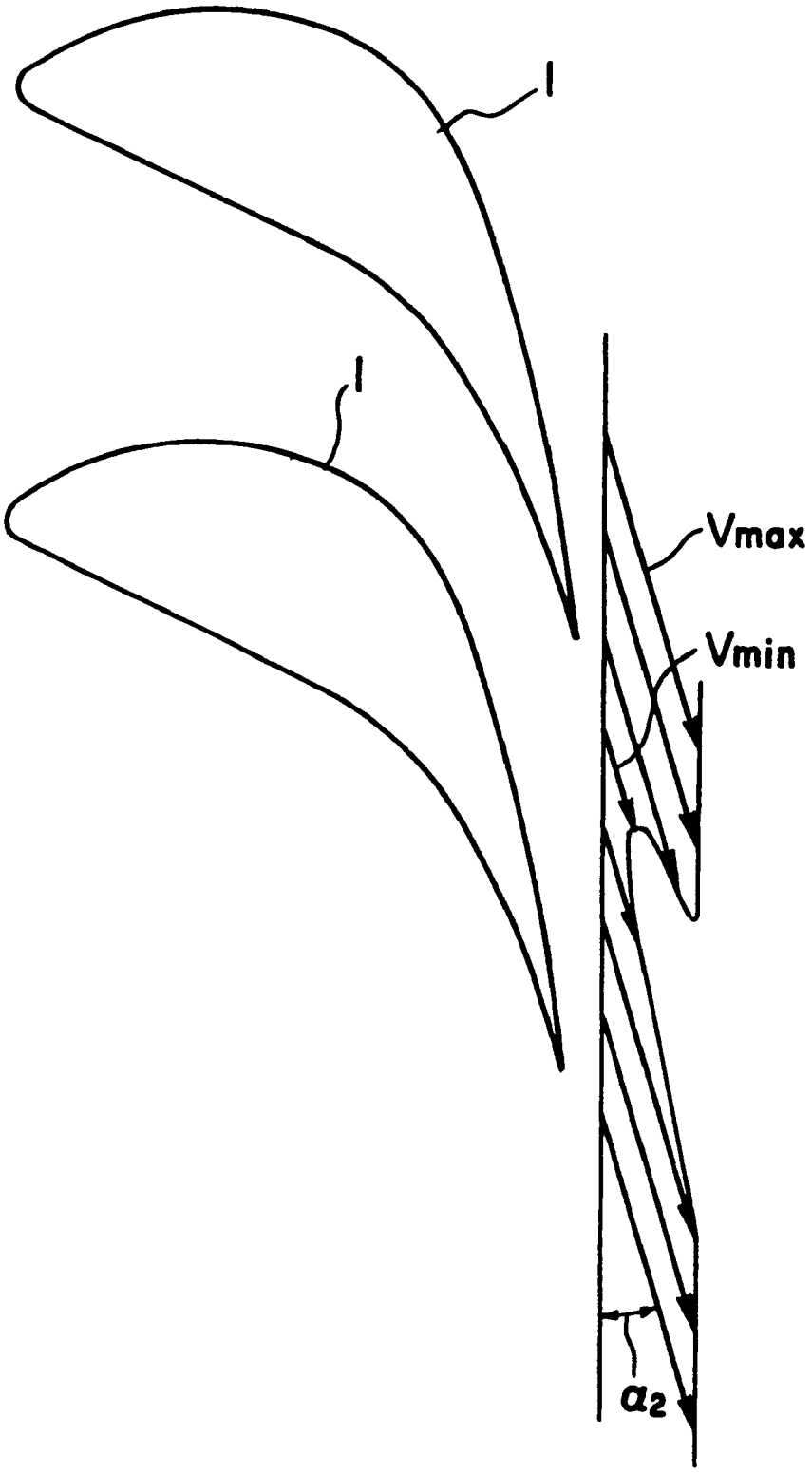
FIG. 10 is a cross-sectional view of the nozzle blade of assistance in explaining a nozzle wake.
Figure 11:
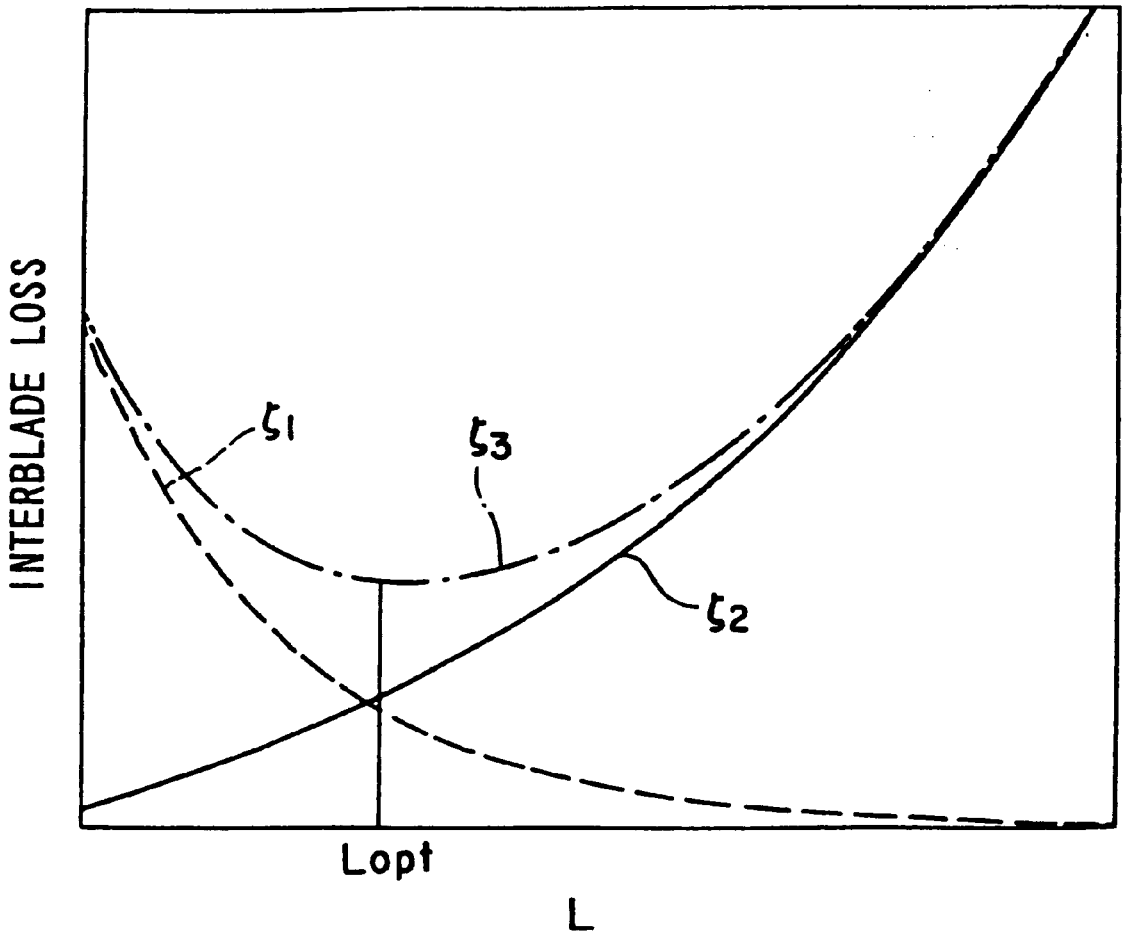
FIG. 11 is a graph of assistance in explaining interblade loss between the nozzle blades and moving blades.
Figure 12:
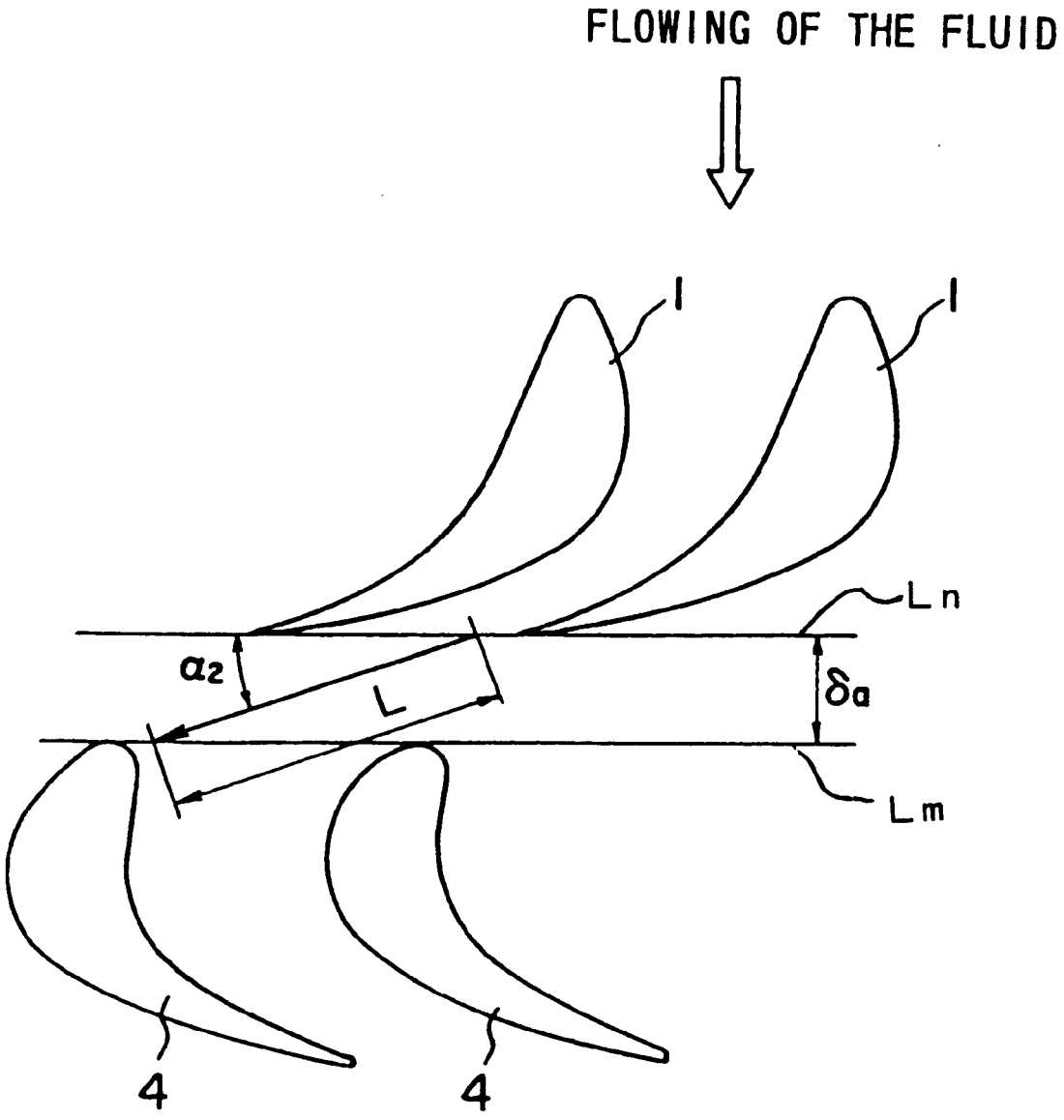
FIG. 12 is a cross-sectional view of the nozzle blades and the moving blades of assistance in explaining the relationship between an axial distance, an outlet flow angle and a distance in a direction of flow between the nozzle blade and the moving blade.
Figure 13:
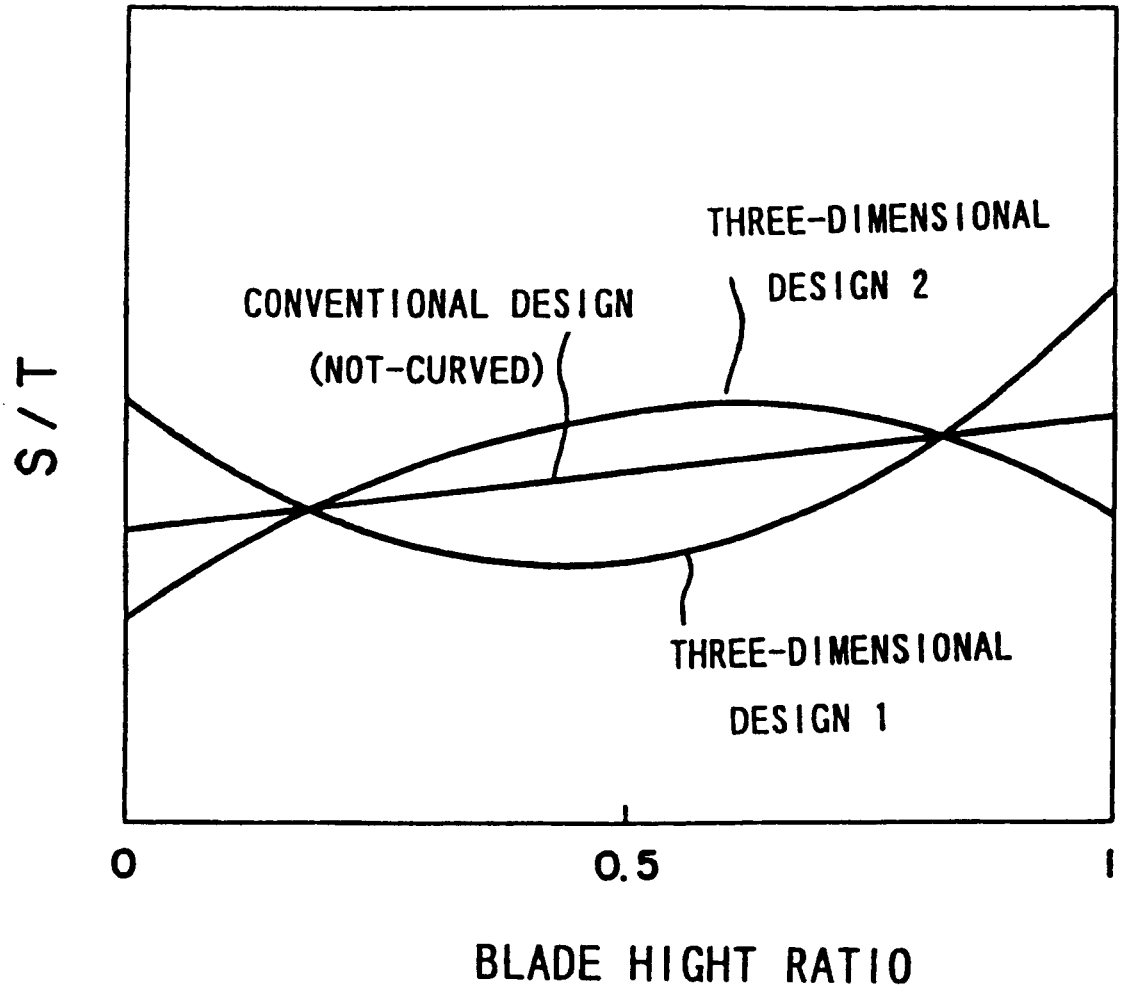
FIG. 13 is a graph showing the distribution of the ration S/T of the nozzle blades of the "three-dimensional designs 1 and 2"

Nozzle blades of different blade lengths have different inclinations θ, respectively. FIG. 5 shows curves indicating the dependence of efficiency ratio on the inclination θ for a long blade H1 (typically employed in high pressure stages), a medium blade H2 (typically employed in from high to low pressure stages) and a short blade H3 (typically employed in low pressure stages). All the curves increase with the increase of the inclination θ, reach maximum, respectively, and then decrease as the inclination further increases. The efficiency ratio for each of the blades H1, H2 and H3 decreases below 1.0 when the inclination θ increases beyond a limit inclination. A limit inclination for the long blade H1 is 5 degrees. Therefore, it is desirable that the inclination θ is in the range of 0 degree to 5 degree.

Figure 3:
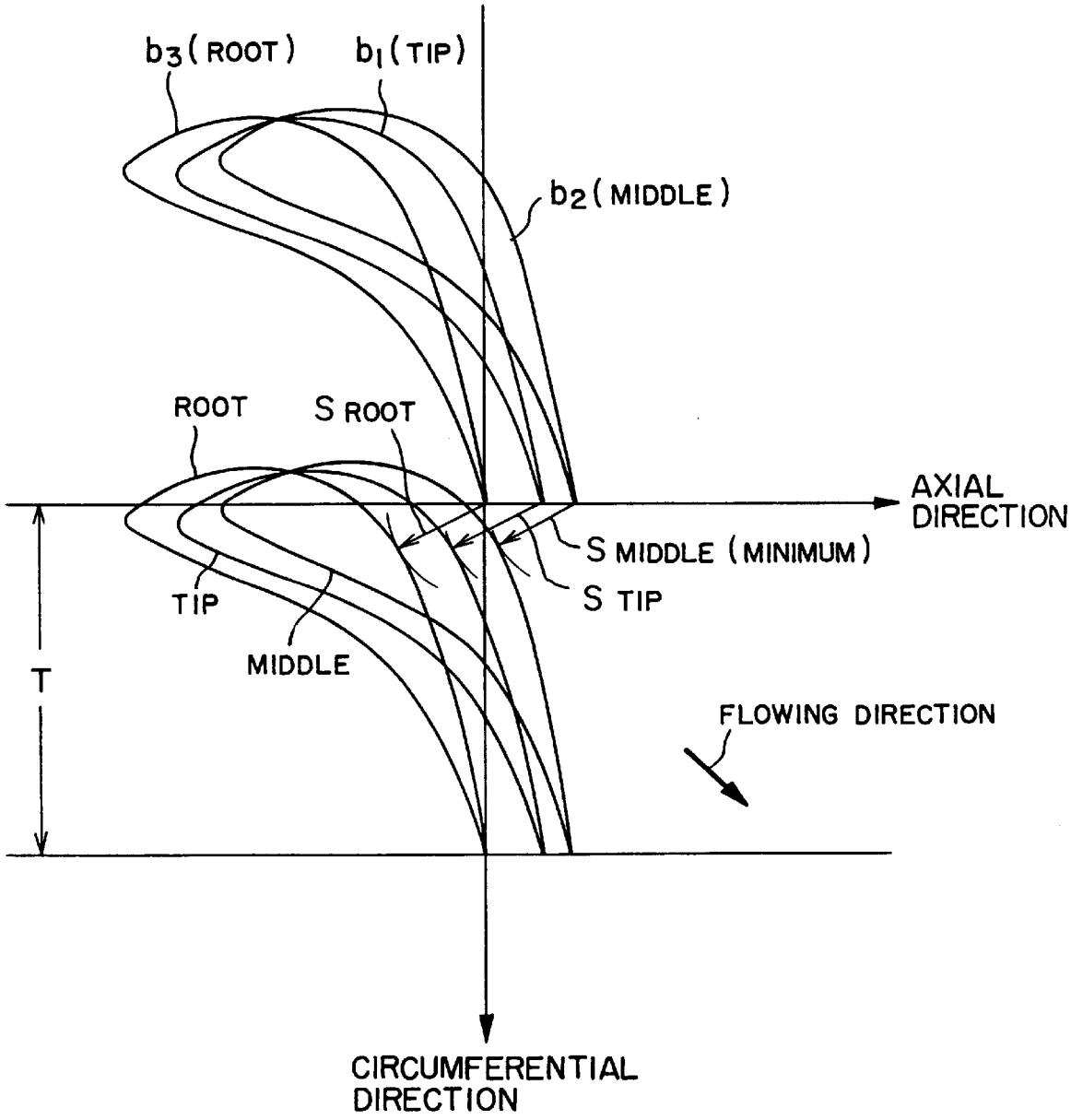
FIG. 3 shows cross sectional views, of tip, middle and root portions of adjacent nozzle blades of a turbine nozzle in a second embodiment according to the present invention.

Referring to FIG. 3, a turbine nozzle in a second embodiment according to the present invention will be described hereinafter. The nozzle blade in the second embodiment employs nozzle blades of a "three-dimensional design 1" capable of controlling the flow distribution along the blade length to reduce secondary flow loss caused in the vicinity of the side wall surface of the diaphragm inner and outer rings. The ratio S/T, where S is the shortest distance between the trailing edge of the nozzle blade and the back surface, i.e., convex suction side surface of another nozzle blade adjacent to the former, and T is the pitch of the nozzle blades, is varied in the direction of the blade length to optimize flow distribution along the blade length. The ration S/T reaches a minimum at a middle portion of the nozzle blades.

The nozzle blades of this embodiment is designed so that the middle section of the each nozzle blade is dislocated in the flowing direction relative to the root section and the tip section, with respect to the axial direction.

Figure 14:
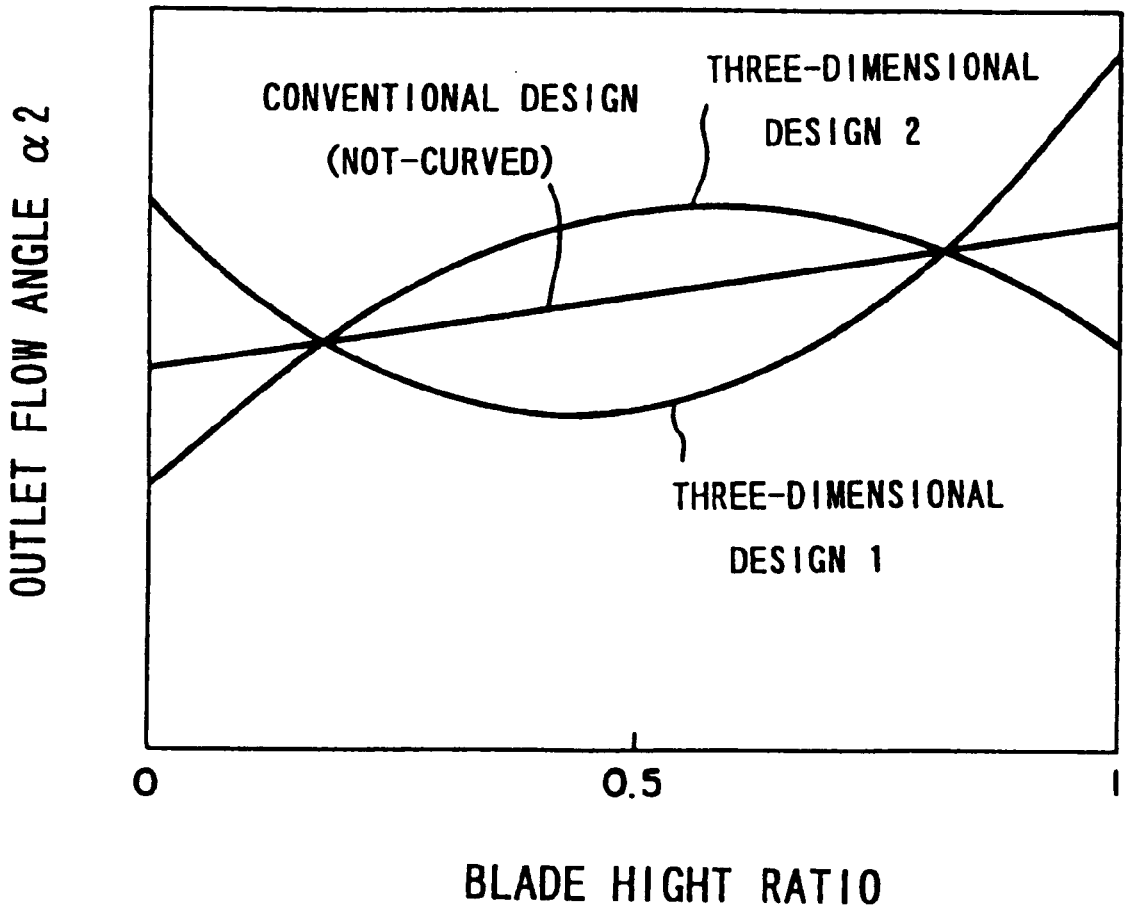
FIG. 14 is a graph showing the distribution of the outlet flow angle of the nozzle of the three-dimensional designs 1 and 2"
Figure 15:
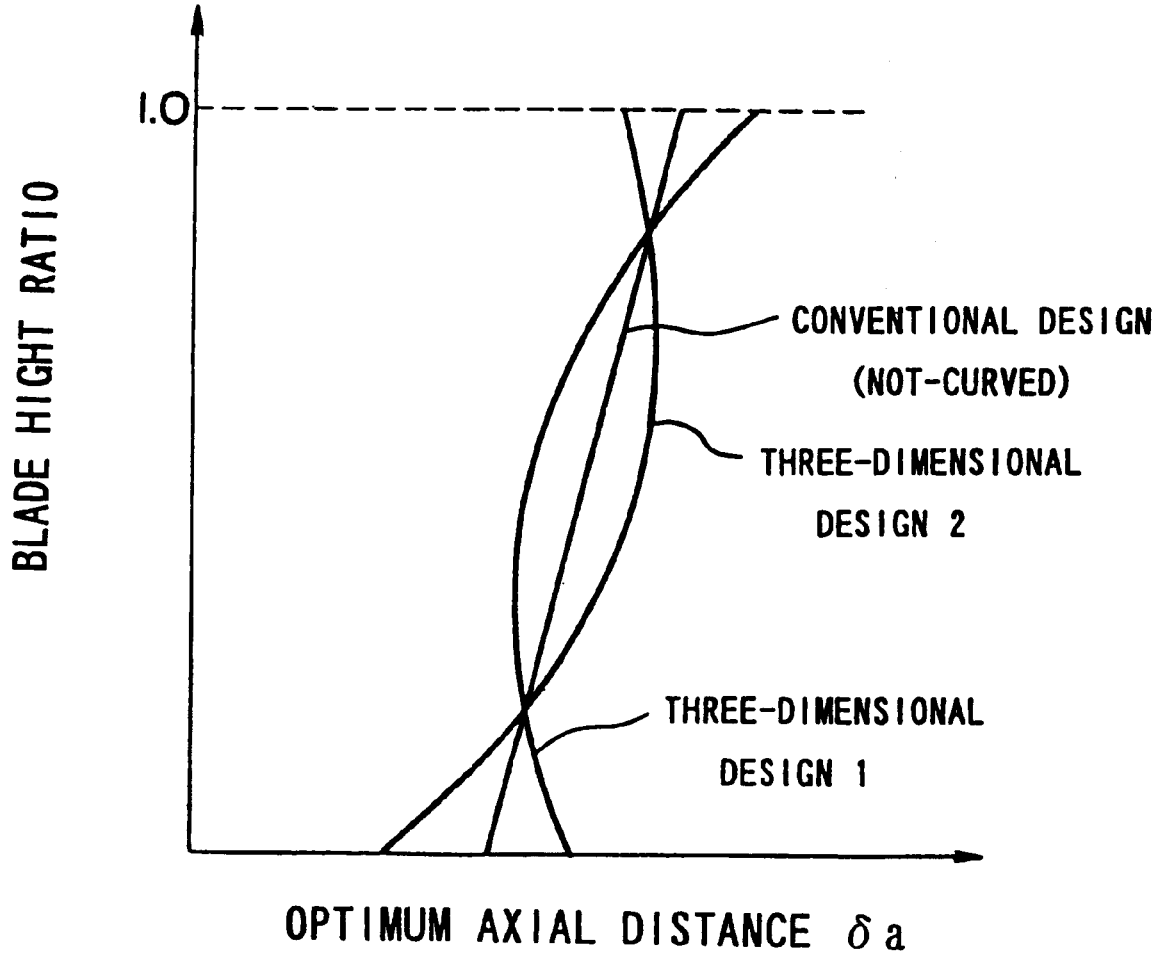
FIG. 15 is a graph of assistance in explaining an optimum axial distance.

Since nozzle blades have the minimum value for the ration S/T at the middle portion thereof, the outlet flow angle is relatively small at the middle portion of each fluid passage section, and is relatively large at the root portion and the tip portion thereof, as shown in FIG. 14. Since the outlet flow angle thus varies along the blade length, the optimum axial distance is relatively short at the middle portion, and is relatively long at the root portion and the tip portion of the nozzle blade as shown in FIG. 15.

In this embodiment, each nozzle blade is curved in a curve convex toward the flowing direction of the fluid, by shifting middle section of the each nozzle blade toward the flowing direction relative to the root section and the tip section, with respect to the axial direction. Thus, an optimum axial distance can be determined and, consequently, interblade loss can be reduced and internal efficiency can be improved.

In this embodiment, it is also preferable that the line connecting a point corresponding to the root side end of the trailing edge of the nozzle blade, and a point corresponding to the tip side end of the trailing edge of the nozzle blade, is inclined toward the fluid outlet side, for the same reason as explained in the description of the first embodiment.

Figure 4A:
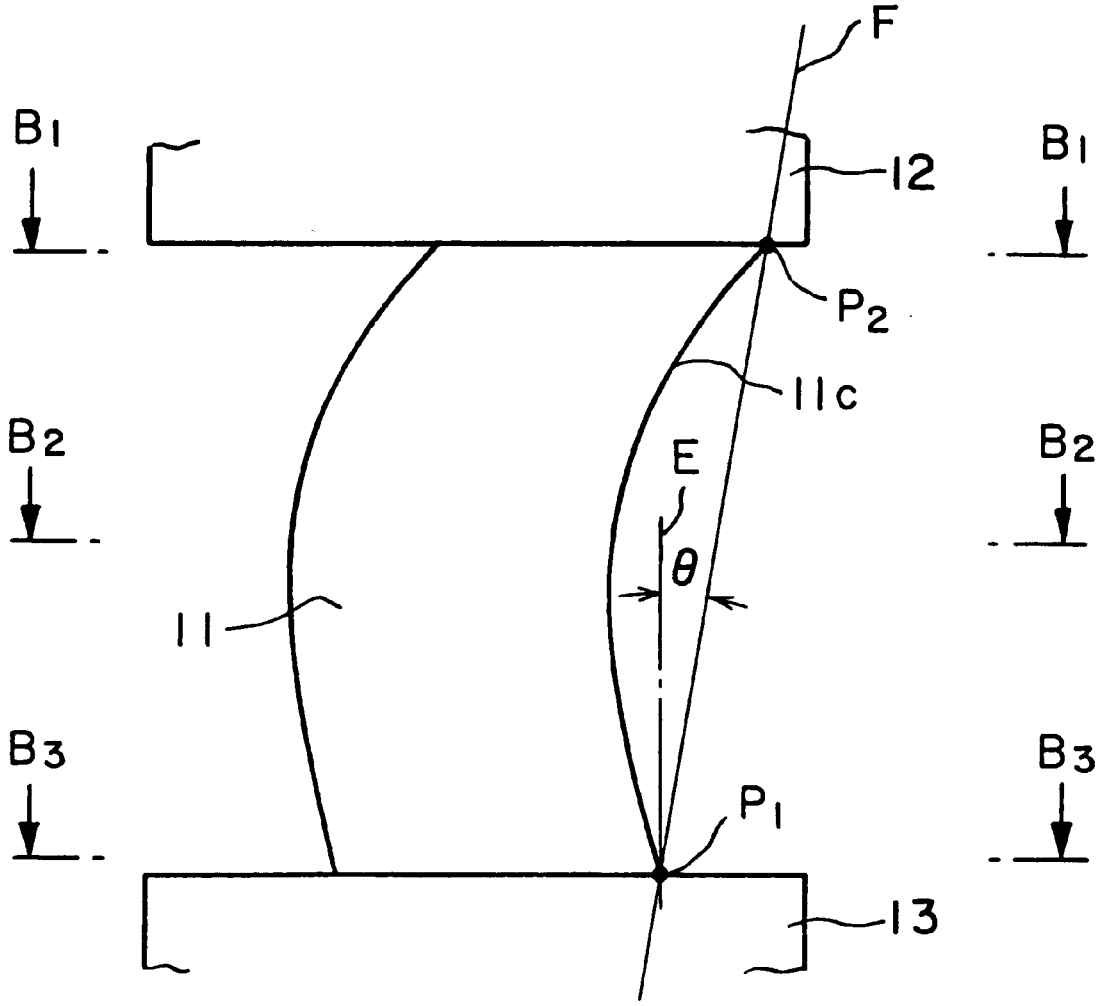
FIG. 4A is typical view of a turbine nozzle in a third embodiment according to the present invention.
Figure 4B:
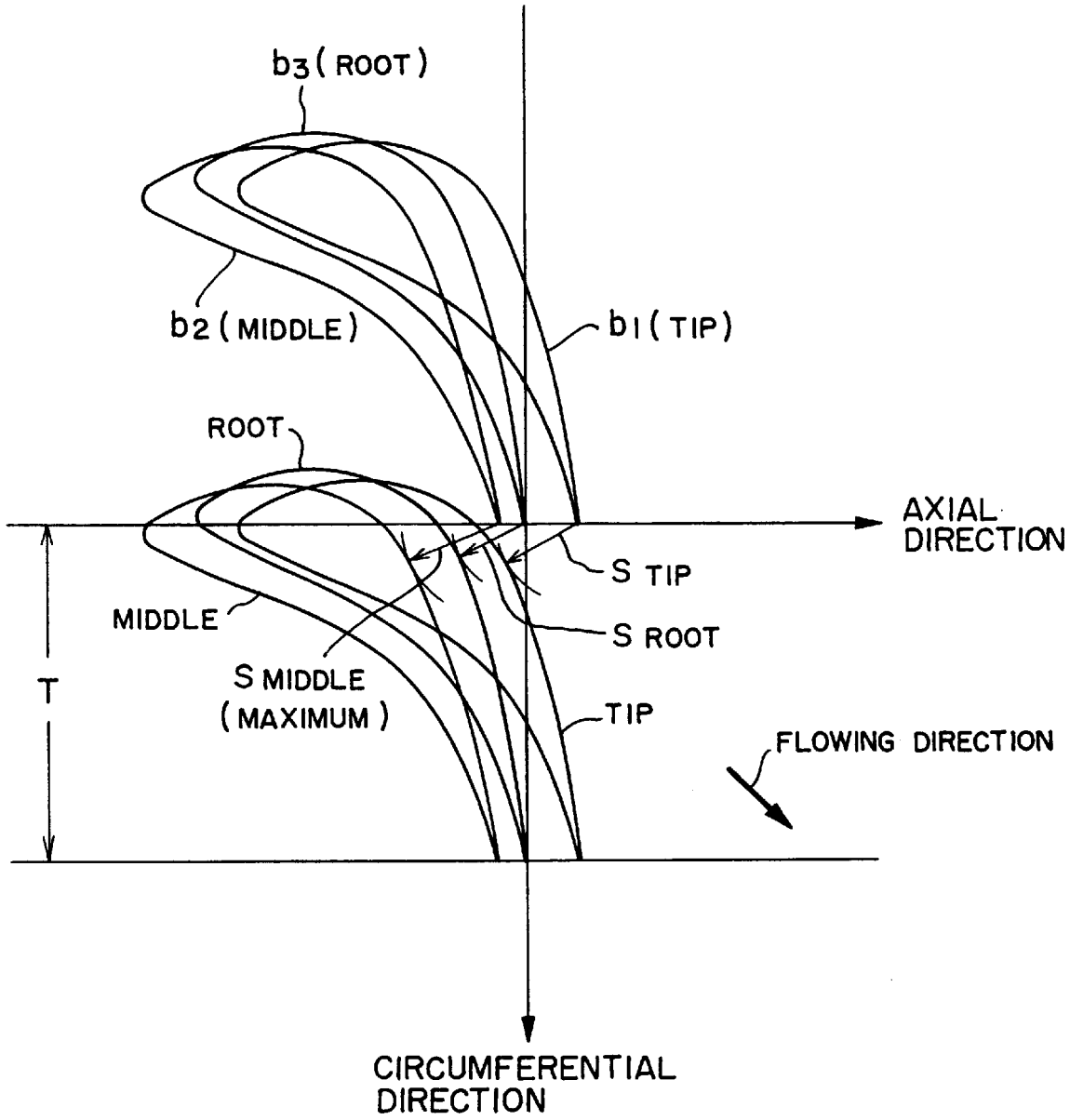
FIG. 4B shows cross sections along lines B1—B1, B2—B2 and B3—B3 in FIG. 4A.

Referring to FIGS. 4A and 4B, a turbine nozzle in a third embodiment according to the present invention will be described hereinafter. The nozzle blade in the third embodiment employs nozzle blades of a "three-dimensional design 2" capable of controlling flow distribution along the blade length to reduce secondary flow loss by increasing flow rates, relatively to in the root and tip portion of the flow passage between the blades, in the middle portion thereof. The ratio S/T, where S is the shortest distance between the trailing edge of the nozzle blade and the back surface, i.e., convex suction side surface of another nozzle blade adjacent to the former, and T is the pitch of the nozzle blades, is varied along the direction of the blade length to optimize flow distribution along the blade length. The ratio S/T reaches a maximum at a middle portion of the nozzle blades.

The nozzle blades of this embodiment is designed so that the middle section of the each nozzle blade is dislocated, shown in FIG. 4B, in a direction opposite to the flowing direction of the fluid relative to the root section and the tip section, with respect to the axial direction.

Since nozzle blades have the maximum value for the ratio S/T at the middle portion thereof, the outlet flow angle is relatively large at the middle portion of each fluid passage section, an is relatively small at the root portion and the tip portion thereof, as shown in FIG. 14. Since the outlet flow angle thus varies along the blade length, the optimum axial distance is relatively long at the middle portion, and is relatively short at the root portion and the tip portion of the nozzle blade as shown in FIG. 15.

In this embodiment, each nozzle blade is curved in a curve convex toward the direction opposite to the flowing direction of the fluid, by shifting middle section of the each nozzle blade toward the direction opposite to the flowing direction relative to the root section and the tip section, with respect to the axial direction. Thus, an optimum axial distance can be determined and, consequently, interblade loss can be further reduced and internal efficiency can be improved.

In this embodiment, it is also preferable that the line connecting a point P1 corresponding to the root side end of the trailing edge of the nozzle blade, and a point P2 corresponding to the tip side end of the trailing edge of the nozzle blade, is inclined toward the fluid outlet side, for the same reason as explained in the description of the first embodiment.

Although the invention has been described in its preferred form with a certain degree of particularity, obviously many changes and variations are possible therein. It is therefore to be understood that the present invention may be practiced otherwise than as specifically described herein without departing from the scope and spirit thereof.

What is claimed is:

1. A turbine nozzle comprising:

an annular diaphragm inner ring disposed coaxially with a predetermined axis;

an annular diaphragm outer ring disposed coaxially with the diaphragm inner ring so as to define an annular fluid passage between the diaphragm inner ring and the diaphragm outer ring; and a plurality of nozzle blades arranged in a circumferential arrangement in the fluid passage between the diaphragm inner ring and the diaphragm outer ring and each blade having a root and a tip located respectively at the diaphragm inner ring side and the diaphragm outer ring side;

wherein the nozzle blades are curved so that the ratio S/T, where S is the minimum distance between the trailing edge of each nozzle blade and back surface of the nozzle blade adjacent to the former nozzle blade, and T is the pitch of the nozzle blades, is a minimum at a middle portion of the nozzle blade, and wherein the middle portion of each nozzle blade has a section dislocated in a flowing direction of a fluid which flows through the fluid passage relative to the root section and the tip section of the blade with respect to an axial direction.

2. The turbine nozzle according to claim 1, wherein a line connecting a point corresponding to the root side end of a trailing edge of each nozzle blade, and a point corresponding to the tip side end of the trailing edge of each nozzle blade is inclined at a fixed angle towards a fluid outlet side to a radial line of the nozzle blade.

3. A turbine nozzle comprising:

an annular diaphragm inner ring disposed coaxially with a predetermined axis;

an annular diaphragm outer ring disposed coaxially with the diaphragm inner ring so as to define an annular fluid passage between the diaphragm inner ring and the diaphragm outer ring; and a plurality of nozzle blades arranged in a circumferential arrangement in the fluid passage between the diaphragm inner ring and the diaphragm outer ring and each blade having a root and a tip located respectively at the diaphragm inner ring side and the diaphragm outer ring side;

wherein the nozzle blades are curved so that the ratio S/T, where S is the minimum distance between the trailing edge of each nozzle blade and the back surface of the nozzle blade adjacent to the former nozzle blade, and T is the pitch of the nozzle blades, is a maximum at a middle portion of the nozzle blade, and wherein the middle portion of each nozzle blade has a section dislocated in a direction opposite to a flowing direction of a fluid which flows through the fluid passage relative to the root section and the tip section of the blade with respect to an axial direction.

4. The turbine nozzle according to claim 3, wherein a line connecting a point corresponding to the root side end of a trailing edge of each nozzle blade, and a point corresponding to the tip side end of the trailing edge of each nozzle blade is inclined at a fixed angle towards a fluid outlet side to a radial line of the nozzle blade.

* * * * *